US005599356A

United States Patent [19]

Hashimoto et al.

[11] Patent Number: 5,599,356

[45] Date of Patent: Feb. 4, 1997

[54] PROCESS FOR PRODUCING AN AQUEOUS HIGH CONCENTRATION COAL SLURRY

[75] Inventors: Noboru Hashimoto, Yokohama; Koichi Ito, Tokyo; Shinichi Tokuda; Osamu Matsumoto, both of Yokohama, all of Japan

[73] Assignees: JGC Corporation; Japan Com Company, Ltd., both of Tokyo, Japan

[21] Appl. No.: 284,085

[22] Filed: Aug. 1, 1994

Related U.S. Application Data

[63] Continuation-in-part of Ser. No. 993,813, Dec. 18, 1992, abandoned, which is a continuation of Ser. No. 493,405, Mar. 14, 1990, abandoned.

[51] Int. Cl.[6] ..... C10L 1/32; B02C 17/00; B65G 53/30

[52] U.S. Cl. ..... 44/280

[58] Field of Search ..... 44/280; 241/16, 241/24, 21, 29

[56] References Cited

U.S. PATENT DOCUMENTS

| | | | |
|---|---|---|---|
| 4,305,729 | 12/1981 | Stearns | 44/51 |
| 4,465,495 | 8/1984 | Scheffee | 44/280 |
| 4,494,959 | 1/1985 | Funk | 44/280 |
| 4,613,084 | 9/1986 | Takamoto | 44/51 |
| 4,706,891 | 11/1987 | Nakaoji | 44/51 |
| 4,746,325 | 5/1988 | Nakamura | 44/51 |
| 4,756,720 | 7/1988 | Kikkawa | 44/280 |
| 4,762,526 | 8/1988 | Funaji | 44/627 |
| 4,786,289 | 11/1988 | Shoji et al. | 44/280 |

FOREIGN PATENT DOCUMENTS

| | | |
|---|---|---|
| 58-38791 | 3/1983 | Japan . |
| 157184 | 9/1984 | Japan . |
| 59-157184 | 9/1984 | Japan . |
| 60-18585 | 1/1985 | Japan . |
| 61-57689 | 3/1985 | Japan . |
| 60-156796 | 8/1985 | Japan . |
| 156796 | 8/1985 | Japan . |
| 62-116691 | 5/1987 | Japan . |
| 62-265392 | 11/1987 | Japan . |
| 265392 | 11/1987 | Japan . |

*Primary Examiner*—Margaret Medley
*Attorney, Agent, or Firm*—Michael N. Meller

[57] ABSTRACT

An aqueous high concentration coal slurry having a high dispersion stability is produced by a process in which a coal material is wet pulverized at a low concentration in a dispersing agent-free aqueous medium, the resultant coal slurry is hydrated, the dehydrated coal cakes are mixed with an aqueous dispersing additive solution to provide an aqueous coal slurry (A), a portion (B) of the slurry (A) is further pulverized, and the pulverized portion (B) is mixed with the remaining portion (D) of the slurry (A), or by a process in which a coal material is pulverized in an aqueous dispersing agent solution to provide a slurry moiety (E), separately a cake moiety (E) is provided, the slurry moiety (E) is mixed with the cake moiety (E) the above-mentioned process being carried out to an extent such that the resultant coal slurry contains coal particles having a size of 5 μm or less in a content of 15% by weight or more and coal particles having a size of 500 μm or less at a particle size distribution in which a variation coefficient C in size of the coal particles is 0.3 to 0.75.

3 Claims, 5 Drawing Sheets

PROCESS FOR PRODUCING AN AQUEOUS HIGH CONCENTRATION COAL SLURRY

CROSS REFERENCE TO RELATED APPLICATIONS

This application is a continuation-in-part application of application Ser. No. 07/993,813 filed Dec. 18, 1992, now abandoned which was a continuation of application Ser. No. 07/493,405 filed on Mar. 14, 1990, and now abandoned.

BACKGROUND OF THE INVENTION

1) Field of the Invention

The present invention relates to a process for producing an aqueous high concentration coal slurry. More particularly, the present invention relates to a process for producing an aqueous high concentration coal slurry having an excellent stability during storage and transportation.

2) Description of the Related Arts

Recently, the importance of coal as an energy source has been revalued, but coal is disadvantageous in that it is a solid material and thus is difficult to transport, store and handle, in comparison with oil.

Accordingly, many attempts have been made to eliminate the above-mentioned disadvantages by finely pulverizing a coal material, dispersing the resultant fine coal particles in an aqueous medium to provide an aqueous coal slurry which can be stored, transported and handled as a liquid material, and supplying the aqueous coal slurry as a fuel for boilers for power plants and other industrial uses. For example, such attempts are disclosed in Japanese Unexamined Patent Publication (Kokai) Nos. 58-38791, 60-18585, 61-57689 and 62-116691.

For the aqueous coal slurry, it is necessary to increase the concentration of coal particles and to enhance the stability in transportation and storage. A high concentration aqueous coal slurry should comprise 60% to 75% by weight of finely pulverized coal particles and 25% to 40% of an aqueous medium containing a small amount of an additive, for example, a dispersing agent, and this high concentration of coal particles can be obtained by adjusting the size of the coal particles in the aqueous slurry to a suitable level and distribution thereof, and by adding an appropriate additive to the aqueous slurry.

Therefore, attempts have been made to provide a method of controlling the distribution of the size of the coal particles in the aqueous slurry in accordance with an optimum particle size distribution formula. Those attempts, however, are not always satisfactory. Also, the conventional methods are disadvantageous in that the high concentration of coal particles in the aqueous slurry can be realized only by adding a relatively large amount of a dispersing agent to the aqueous medium.

SUMMARY OF THE INVENTION

An object of the present invention is to provide a process for producing an aqueous high concentration coal slurry having an excellent stability during transportation and storage.

The above-mentioned object can be attained by the process of the present invention for producing an aqueous high concentration coal slurry, comprises the steps of:

preparing dehydrated coal cakes comprising coal particles having a size of 500 μm or less, by wet pulverizing a coal material at a low concentration of 50% by weight or less in water free from a dispersing additive, and dehydrating the resulting low concentration aqueous coal slurry;

mixing the dehydrated coal cakes with water and a dispersing additive in a kneader to provide an aqueous coal slurry (A) containing 60% to 80% by weight of the coal particles;

subjecting a portion (B) of the aqueous coal slurry (A) in an amount of 50% to 80% by weight of the aqueous coal slurry (A) to a pulverizer to further finely pulverize the coal particles in the portion (B); and mixing the resultant further pulverized portion (B) with the remaining portion (D) of the aqueous coal slurry (A), wherein the fine pulverizing procedure of the portion (B) is carried out to an extent such that, after the further finely pulverized portion (B) is mixed with the remaining portion (D), the resultant high concentration aqueous coal slurry contains coal particles having a size of 5 μm or less in an amount of 15% by weight or more based on the total weight of the coal particles; and the resultant high concentration aqueous coal slurry comprises coal particles having a particle size of 500 μm or less and dispersed in an aqueous medium in the presence of a dispersing additive, at a particle size distribution in which a coefficient of variation in size of the coal particles is from 0.3 to 0.75 determined in accordance with the equation (I):

$$c=\sigma/M \quad \text{(I)}$$

wherein C represents the coefficient of variation in the size of the coal particles, M represents an average general logarithmic size of the coal particles calculated in accordance with the equation (II):

$$M=\Sigma(\log_{10}Si)\times Vi \quad \text{(II)}$$

in which M is as defined above, Si represents an average size in μm of the coal particles in fraction No. i which is one of a plurality of fractions provided by dividing the entire amount of the coal particles in accordance with the order of the particle size, each fraction consisting of coal particles having a size in a predetermined range, and Vi represents a ratio of the amount in weight or volume of the portion of the coal particles in fraction No. i to the entire amount of the coal particles and σ represents a standard deviation of the size of the coal particles calculated in accordance with the equation (III):

$$\sigma=(\Sigma((\log_{10}Si-M)^2\times Vi))^{0.5} \quad \text{(III)}$$

in which Si, M and Vi are defined above.

Another process of the present invention for producing an aqueous high concentration coal slurry comprises the steps of:

pulverizing a coal material at a high concentration of 60 to 80% by weight in an aqueous medium containing a dispersing additive, to provide a slurry moiety (E) consisting of a high concentration aqueous coal slurry containing coal particles having a size of 100 μm or less; and separately providing a cake moiety (F) consisting of dehydrated coal cakes containing coal particles having a size of 500 μm or less, by pulverizing a coal material in a low concentration of from 30% to 50% by weight in water free from the dispersing additive, and dehydrating the resultant low concentration aqueous coal slurry; and mixing the slurry moiety (E) with the cake moiety (F), in a mixing ratio such that the ratio in weight of the coal particles in the slurry moiety (E) to those in the cake moiety (F) is in the range of from 8:2 to 5:5, wherein the resultant high concentration aqueous coal slurry contains coal particles having a size of 5 μm or less in an amount of 15% by weight or more based on the total weight of the coal particles, and the resultant high concentration aqueous coal slurry comprises coal particles having a particle size of 500 μm or less and dispersed in an aqueous medium in the presence of a dispersing additive, at a particle size distribution in which a coefficient of variation in size of the coal particles is from 0.3 to 0.75 determined in accordance with the equation (I):

$$C=\sigma/M \quad \text{(I)}$$

wherein C represents the coefficient of variation in the size of the coal particles, M represents an average general logarithmic size of the coal particles calculated in accordance with the equation (II):

$$M=\Sigma(\log_{10}Si)\times Vi \quad \text{(II)}$$

in which M is as defined above, Si represents an average size in μm of the coal particles in fraction No. i which is one of a plurality of fractions provided by dividing the entire amount of the coal particles in accordance with the order of the particle size, each fraction consisting of coal particles having a size in a predetermined range, and Vi represents a ratio of the amount in weight or volume of the portion of the coal particles in fraction No. i to the entire amount of the coal particles and σ represents a standard deviation of the size of the coal particles calculated in accordance with the equation (III):

$$\sigma=(\Sigma((\log_{10}Si-M)^2\times Vi))^{0.5} \quad \text{(III)}$$

in which Si, M and Vi are as defined above.

DESCRIPTION OF THE PREFERRED EMBODIMENTS

Figure 1:
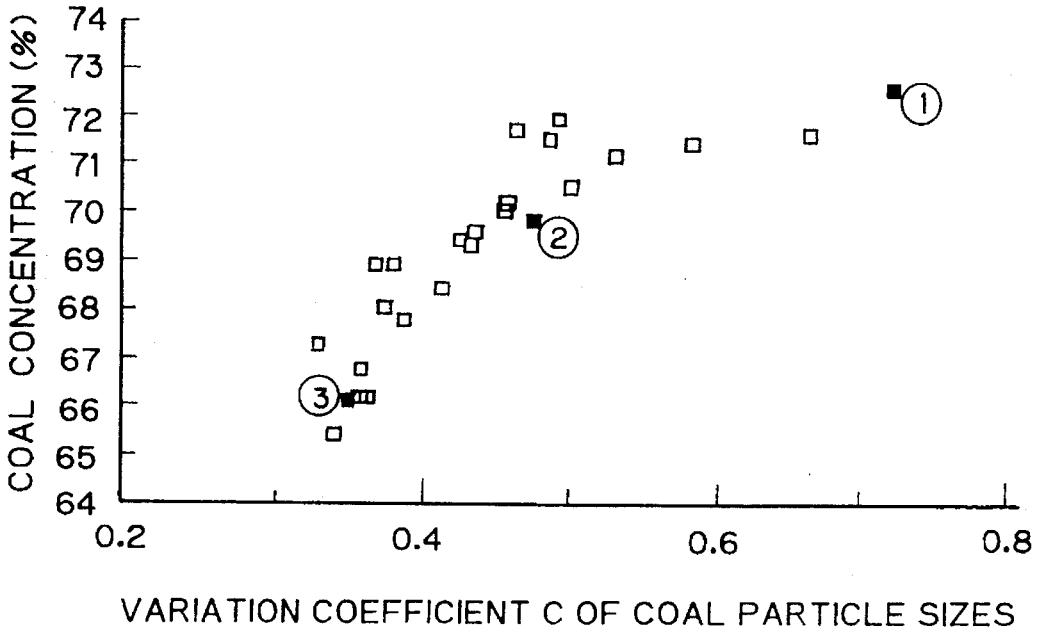
FIG. 1 shows a relationship between the coefficient C of variation in the size of coal particles and the concentration of the coal particles in a aqueous coal slurry of the present invention, having a viscosity of 1000 cp.

The inventors of the present invention made various attempts to eliminate the disadvantages of the conventional aqueous coal slurries, and during those attempts, the inventors carried out research into the relationship between the distribution of sizes of the coal particles in the aqueous coal slurry and the stability of the coal particles dispersed in the slurry, and discovered that the stability of an aqueous coal slurry having a wide distribution of size of coal particles and containing very fine coal particles in a large enough amount is higher than that of another coal aqueous slurry having a narrow distribution of size of coal particles having one single peak.

Namely, a coal powder consisting essentially of three types of fine coal particles, each type having a different size, and having particle size distribution peaks at sizes of about 10 μm about 20 μm, and about 40 μm, was mixed with another coal powder consisting essentially of three types of coarse coal particles, each type having a different size, and having particle size distribution peaks at sizes of about 80 μm, about 160 μm, and about 300 μm, at a mixing ratio of 10:90 to 90:10 by weight, and each mixture was dispersed and kneaded in an aqueous medium containing an anionic surface active agent, by a kneader. From research into the physical properties of the resultant aqueous coal slurries, it was concluded that an aqueous coal slurry having a coefficient C of variation in size of the coal particles dispersed therein, of from 0.3 to 0.75, preferably from 0.5 to 0.75, determined from the equation (I):

$$C=\sigma/M \quad \text{(I)}$$

exhibits a satisfactory concentration and stability during storage and transportation over a long period.

In the equation (I), C represents the coefficient of variation in the size of the coal particles, M represents an average general logarithmic size of the coal particles calculated from the equation (II):

$$M=\Sigma(\log_{10}Si)\times Vi \quad \text{(II)}$$

in which M is as defined above, Si represents an average size in μm of a portion of the coal particles in fraction No. i which is one of a plurality of fractions provided by dividing the entire amount of the coal particles in accordance with the order of the particle size, each fraction consisting of coal particles having a size in a predetermined range, and Vi represents a ratio of the amount in weight or volume of the portion of the coal particles in fraction No. i to the entire amount of the coal particles, and σin the equation (I) represents a standard deviation of the size of the coal particles calculated from the equation (III):

$$\sigma=(\Sigma((\log_{10}Si-M)^2\times Vi))^{0.5} \quad \text{(III)}$$

in which Si, M and Vi are as defined above.

As stated above, the variation coefficient C in the size of the coal particles should be from 0.3 to 0.75. Usually, the variation coefficient C of the coal particle size is preferably 0.5 to 0.75.

When the variation coefficient C of the coal particle size is less than 0.3, the resultant coal aqueous slurry has an unsatisfactorily low concentration and exhibits a poor stability.

Also, when the variation coefficient C of the coal particle size is more than 0.75, the resultant aqueous coal slurry is disadvantageous in that the necessary pulverizing energy increases and the control of the particle size distribution becomes difficult.

In the aqueous coal slurry produced by the process of the present invention, the coal particles must have a size of 500μm, or less, preferably 300 μm or less, more preferably 200 μm or less.

When the maximum size of the coal particles is more than 500 μm, the resultant aqueous coal slurry has a disadvantage in that, when the aqueous coal slurry is subjected to combustion, the amount of unburnt carbon becomes undesirably large.

FIG. 1 indicates a relationship between the variation coefficient C in size of coal particles in a coal aqueous slurry and the concentration of coal particles in an aqueous coal slurry having a viscosity of 1000 cp.

The distribution of the coal particle size can be determined by an apparatus for the measurement of particle size distribution available under the trademark of Microtrac Model SRA 7995-10, from Leeds & Northrup Co.

The concentration of coal particles in an aqueous slurry thereof can be determined in accordance with the heat-drying method of Japanese Industrial Standard (JIS) M 8812.

In view of FIG. 1, it is understood that where the variation coefficient C of coal particle sizes is in the range of from 0.3 to about 0.5, the concentration of the coal particles in the aqueous coal slurry having a viscosity of 1000 cp is in the range of from about 65% to about 72% and increases with the increase in the variation coefficient C of the coal particle sizes, and where the variation coefficient C of the coal particle sizes is more than 0.5, the concentration of the coal particles in the aqueous coal slurry having a viscosity of 1000 cp becomes substantially constant at a level of about 71% to about 73%.

Figure 2:
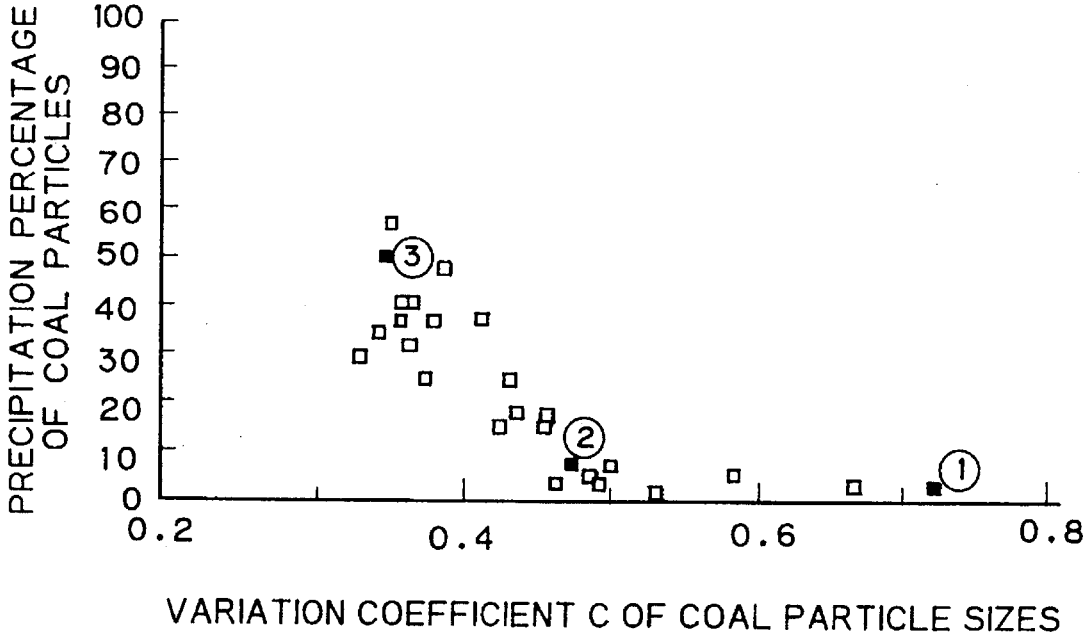
FIG. 2 shows a relationship between the coefficient C of variation in the size of coal particles and the precipitation percentage of the coal particles in the aqueous coal slurry when the coal aqueous slurry is subjected to a dispersion stability test by a centrifugal acceleration tester.

FIG. 2 shows the relationship between the variation coefficient C of the coal particle sizes in an aqueous coal slurry and the precipitation percentage of the coal particles when a dispersion stability test is applied to the aqueous coal slurry in the following manner.

In the dispersion stability test, an aqueous coal slurry is subjected to a 20G centrifugal acceleration test for 8 hours, and the percentage of the precipitated portion of the coal particles based on the entire weight of the coal particles in the coal aqueous slurry is calculated.

FIG. 2 indicates that the precipitation percentage of the coal particles at a satisfactory level of about 60% or less can be obtained at a variation coefficient of the coal particle sizes of the aqueous coal slurry of 0.3 to 0.75. In particular, where the variation coefficient C of the coal particle sizes is about 0.5 to 0.75, the precipitation percentage of the coal particles is substantially constant at a level of 10% or less.

Figure 3:
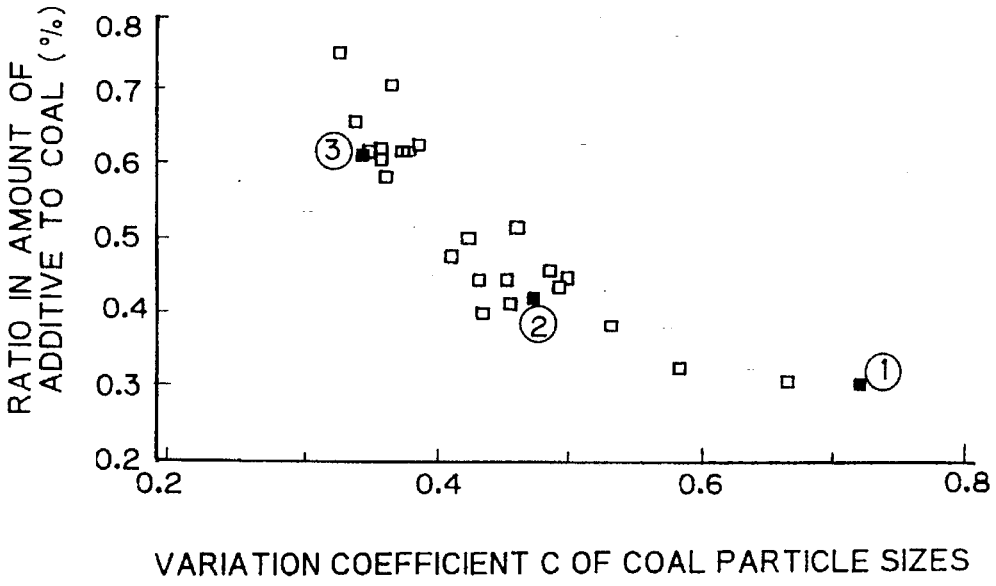
FIG. 3 shows a relationship between the coefficient C of variation in the size of the coal particles in the aqueous coal slurry and the ratio of the minimum amount of a dispersing agent necessary to adjust the viscosity of the aqueous coal slurry to a predetermined level at a predetermined concentration of the coal particles to the entire amount of the coal particles.

FIG. 3 shows the relationship between the variation coefficient C of the coal particle sizes of an aqueous coal slurry and the ratio (%) of the minimum amount of a dispersing agent needed to adjust the viscosity of the aqueous coal slurry to a standard level of 1000 cp. at the concentration as indicated in FIG. 1, to the entire amount of the coal particles.

FIG. 3 shows that, at the variation coefficient C of the coal particle sizes of 0.3 to 0.75, the necessary minimum amount of the dispersing agent is at a satisfactory level of 0.8% or less. In particular, where the variation coefficience is about 0.5 to 0.75, the necessary minimum amount of the dispersing agent is reduced to a low level of 0.4% or less.

Figure 4:
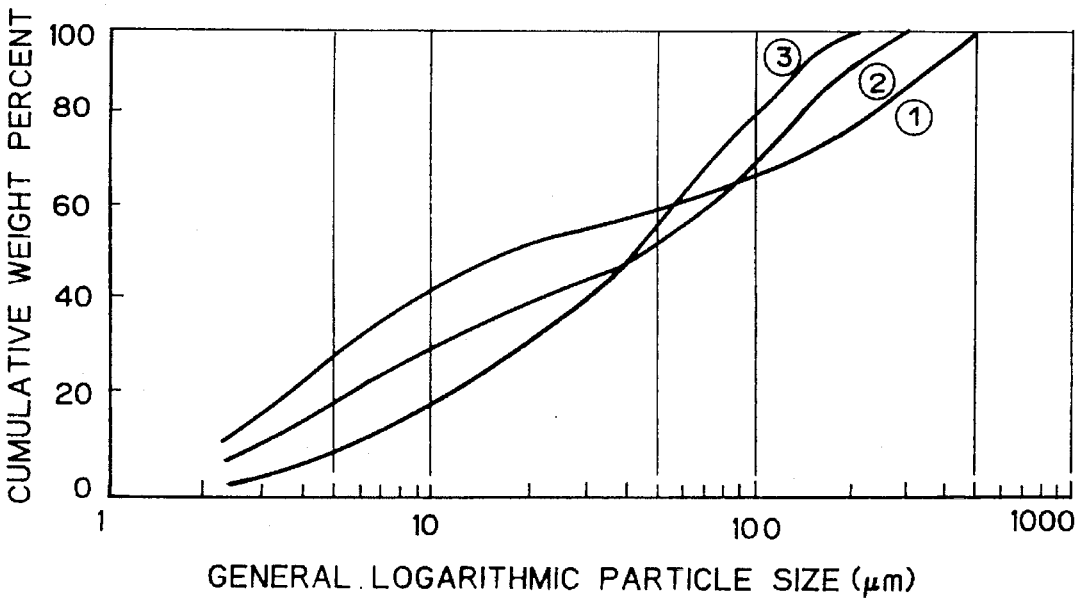
FIG. 4 shows the relationships between the average general logarithmic size in μm of the coal particles in three different types of aqueous coal slurries ①, ② and ③ shown in FIGS. 1 to 3 and the cumulative weight percent of the coal particles having a respective size or less.

The coal particle size distributions of the coal aqueous slurries ①, ② and ③ indicated in FIGS. 1 to 3 are indicated in FIG. 4.

From the coal particle size distribution curves, the variation coefficient C was calculated as follows.

Coal aqueous slurry ①: $C = 0.722$
Coal aqueous slurry ②: $C = 0.473$
Coal aqueous slurry ③: $C = 0.344$ The processes of the present invention for producing the above-mentioned aqueous high concentration coal slurry will be explained in detail below.

In one embodiment of the process of the present invention, a coal material consists of a mixture of two types of portions $P_C$ and $P_F$ each having a different particle size of the coal particles therein.

The coal particles having a size of from 100 μm to 500 μm in portion $P_C$ are in a content of 30% by weight or more.

Also, the coal particles in portion $P_F$ preferably have a size of 100 μm or less, and a content of coal particles having a size of 10 μm or less is 40% by weight or more.

Preferably, the mixing ratio in weight of the portion $P_F$ to the portion $P_C$ is in the range of 8:2 to 5:5.

Also, in the above-mentioned process, the aqueous medium preferably contains a dispersing additive consisting of, for example, at least one dispersing agent for preventing the agglomeration of the coal particles, in an amount needed to adjust the viscosity of the resultant aqueous coal slurry to a standard level of 1000 cp. The amount of the additive is preferably in the range of from 0.3% to 0.8% based on the entire weight of the coal particles in the aqueous coal slurry.

The dispersing agent preferably comprises at least one member selected from non-ion and anion surface active agents usually employed for the conventional aqueous coal slurry.

Optionally, a stabilizer for preventing the deposition of the coal particles is added to the aqueous coal particle slurry. The stabilizer preferably comprises at least one member selected from cellulose compounds, for example, alkali metal salts of carboxymethyl cellulose and xanthan gum materials, usually utilized for the conventional aqueous coal slurry.

In this process of the present invention, a coal material is pulverized by wet-pulverizing at a low concentration of 50% by weight or less in an aqueous medium free from a dispersing additive and the resultant coal particles in the aqueous medium (water) are dehydrated to provide dehydrated coal cakes; the resultant dehydrated coal cakes are mixed with an aqueous medium containing a dispersing additive in a kneader to provide a coal aqueous slurry (A) containing 60% to 80% by weight of the coal particles; a portion (B) of the aqueous coal slurry (A) is subjected to a pulverizer to further finely pulverize the coal particles in the portion (B); and the resultant further finely pulverized portion (B) is mixed with the remaining portion (D) of the aqueous coal slurry (A), to provide an aqueous high concentration coal slurry comprising coal particles having a particle size of 500 μm or less and dispersed in an aqueous medium in the presence of a dispersing additive, at a coal particle size variation coefficient C of 0.3 to 0.75.

In the above-mentioned process, the portion (B) of the coal aqueous slurry (A) is in an amount of 50% to 80%, based on the entire weight of the coal aqueous slurry (A). Also, the fine pulverizing procedure is carried out to an extent such that the resultant further finely pulverized coal particles having a size of 5 μm or less in the portion (B) are in a content of 15% by weight or more.

The above-mentioned embodiment will be further explained with reference to FIG. 5.

Figure 5:
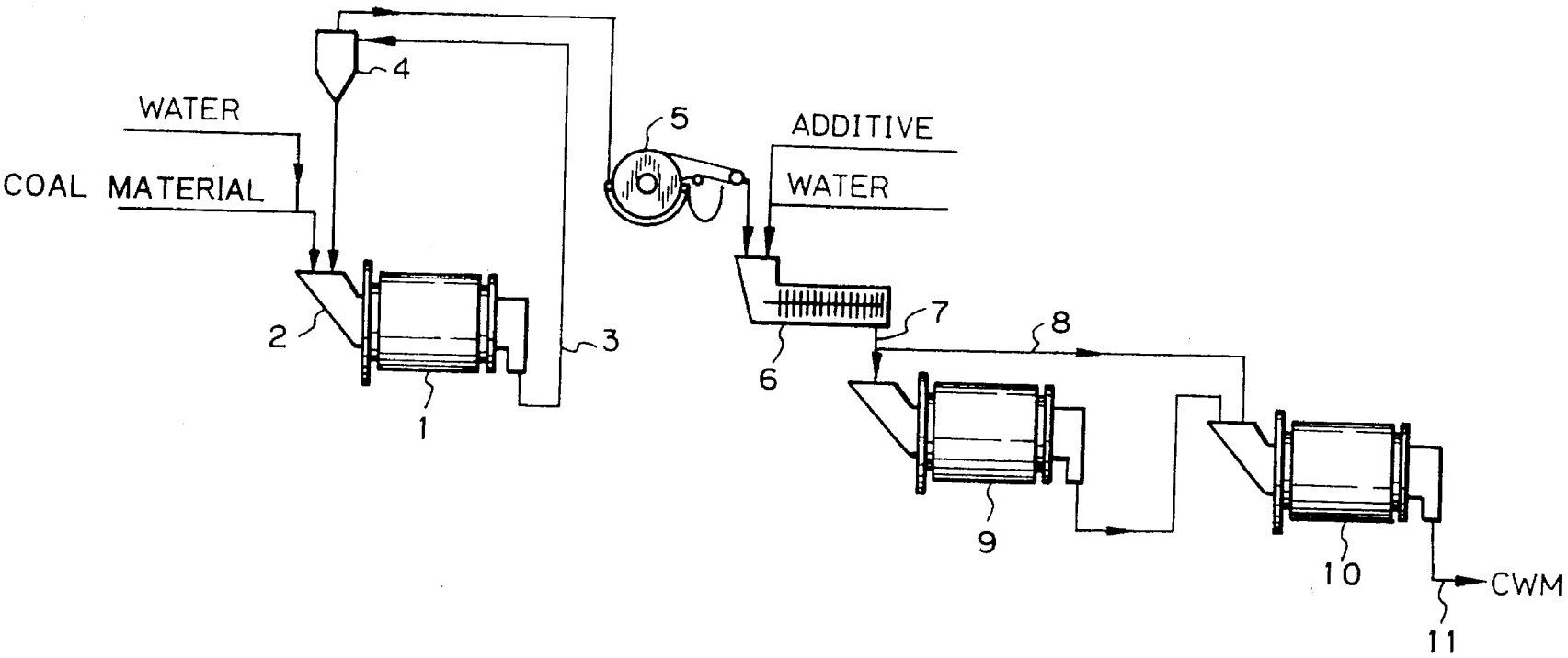
FIG. 5 is a flow sheet showing the process of the present invention for producing the aqueous high concentration coal slurry.

In FIG. 5, a pulverizer or mill 1 is charged with a coal material and an aqueous medium through an inlet 2, and the coal material is pulverized at a low concentration of 50% by weight or less. The resultant aqueous coal slurry is fed into a classifying device 4 through a conduit 3, and a classified portion of the coal aqueous slurry containing coal particles having a particle size of 500 μm or less, preferably 200 μm or less, is fed into a dehydrating device 5 and dehydrated to provide dehydrated coal particle cakes preferably having a water content of from 20% to 32% by weight. The remaining portion of the aqueous coal slurry containing coarse coal particles is returned to the pulverizer 1 through the inlet 2 and re-pulverized.

The coal particle cakes formed in the dehydrating device 5 are introduced into a kneader 6 and mixed in the kneader 6 with an aqueous medium in an amount necessary to adjust the concentration of the coal particles to a level of 60% to 80%, and preferably, containing an additive in an amount of 0.3% to 0.8% based on the entire weight of the coal particles in the cakes.

The resultant aqueous coal slurry (A) is withdrawn from the kneader 6 through a conduit 7. A portion (B) of the aqueous coal slurry (A), preferably in an amount of about 50% to about 80% by weight, is fed into a pulverizer 9 to further finely pulverize the coal particles in the portion (B) and the resultant portion (B) containing the further finely pulverized coal particles is fed into a kneader 10 and mixed therein with the remaining portion (D) of the coal aqueous slurry (A) in an amount of from 20% to 50% by weight, which is directly introduced from the kneader 6 into the kneader 10 through a conduit 8.

The further fine pulverizing procedure is carried out preferably to an extent such that, after the portion (B) is mixed with the remaining portion (D), the resultant aqueous coal slurry contains coal particles having a size of 5 μm or less in a content of 15% by weight or more, more preferably 20% by weight or more, based on the total weight of the coal particles in the resultant aqueous high concentration coal slurry, and the resultant high concentration aqueous coal slurry is recovered from the kneader 10 through a conduit 11.

Figure 6:
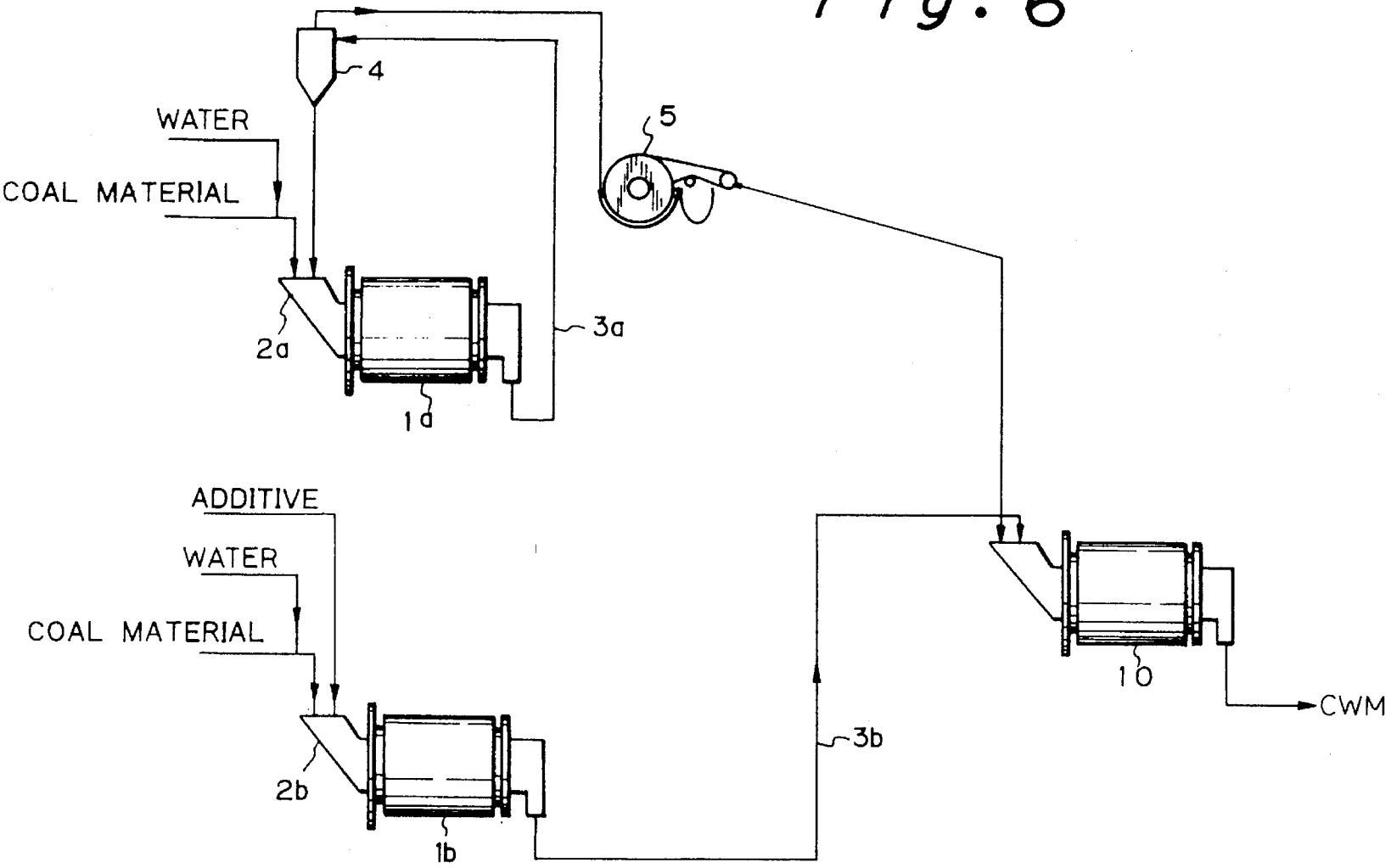
FIG. 6 is a flow sheet showing another process of the present invention for producing the aqueous high concentration coal slurry.

In another embodiment of the process of the present invention for producing the high concentration coal aqueous slurry as indicated in FIG. 6, in a mill la, a coal material is pulverized in a high concentration of 60% to 80% by weight in an aqueous medium containing a dispersing additive to provide a slurry moiety (E) consisting of a high concentration aqueous coal slurry containing coal particles having a size of 100 μm or less; separately, a cake moiety (F) consisting of dehydrated coal cakes containing coal particles having a size of 500 μm or less, preferably 100 μm or more, is prepared by pulverizing, in a mill la, a coal material in a low concentration of, for example, 30 to 50% by weight, in an aqueous medium free from the additive and by dehydrating, in a dehydrating derive 5, the resultant low concentration coal aqueous slurry; and the slurry moiety (E) is mixed with the cake moiety (F), in a kneader 10.

In still another embodiment of the process of the present invention, before the step of mixing the slurry moiety (E) with the cake moiety (F) in the above-mentioned process, the cake moiety (F) may be mixed and kneaded with one or both of an aqueous medium and a portion of the final high concentration coal aqueous slurry prepared in the foregoing procedure, to provide a slurry moiety (G) consisting of an aqueous slurry of coal particles in a concentration of 60% to 80% by weight, and the resultant slurry moiety (G) then mixed with the slurry moiety (E).

In the above-mentioned process, the cake moiety (F) may be further mixed with a dispersing additive in an amount of 0.3 to 0.8% based on the weight of the coal in the slurry moiety (G).

In the slurry moiety (E), the coal particles contained preferably have a size of from 100 μm to 500 μm and are in a content of 30% by weight or more.

Also, in the cake moiety (F) or the slurry moiety (G), the coal particles preferably have a size of 100 μm or less, and contain particles having a size of 10 μm or less in a content of 40% by weight or more.

Preferably, the slurry moiety (E) is mixed with the cake moiety (F) or the slurry moiety (G) in a mixing ratio such that the ratio in weight of the coal particles in the slurry moiety (E) to the coal particles in the cake moiety (F) or the slurry moiety (G) is in the range of from 8:2 to 5:5.

After mixing the slurry moiety (E) with the cake moiety (F) or the slurry moiety (G) in the above-mentioned process, the resultant aqueous high concentration coal slurry contains coal particles having a size of 5 μm or less in a content-of 15% by weight or more, preferably 20% by weight or more, based on the total weight of the coal particles in the resultant aqueous high concentration coal slurry.

Figure 7:
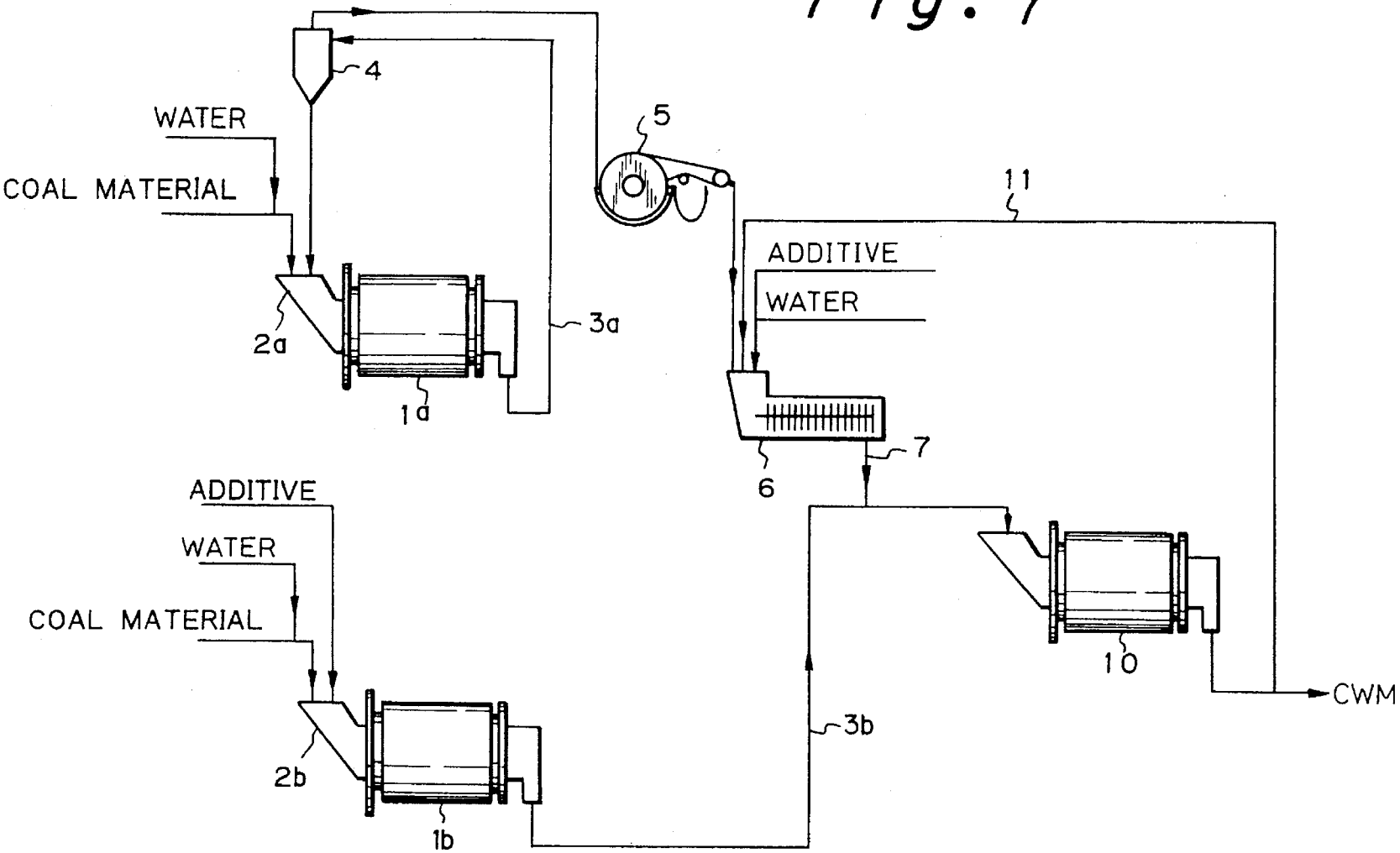
FIG. 7 is a flow chart showing still another process of the present invention for producing the aqueous high concentration cold slurry.

Referring to FIG. 7, a coal material and an aqueous medium free from an additive are charged into a pulverizer or mill la through an inlet **2*a*, to provide an aqueous low concentration coal slurry. The resultant aqueous low concentration coal slurry is introduced into a classifying device 4 through a conduit 3*a* and a classified slurry moiety consisting of a portion of the pulverized aqueous coal slurry and containing coal particles having a size of 500 μm or less, preferably 200 μm or less, is introduced into a dehydrating device 5. The remaining portion of the aqueous coal slurry containing coarse coal particles is recycled to the pulverizer 1*a* through the inlet 2*a*** and re-pulverized.

The cake moiety (F) is introduced from the dehydrating device 5 into a kneader 6 and mixed and kneaded with at least one member selected from an aqueous medium which contains an additive, for example, a dispersing agent, in an amount of 0.3% to 0.8% based on the weight of the coal particles, and a portion of the final aqueous high concentration coal slurry prepared in a foregoing procedure and supplied through a conduit 11, to convert the cake moiety (F) to a slurry moiety (G) consisting of an aqueous slurry of coal particles in a concentration of 60% to 80% by weight.

The slurry moiety (G) is fed from the kneader 6 into a kneader 10 through a conduit 7.

Separately, a coal material, an aqueous medium, and a dispersing additive are fed into a pulverizer **1*b* through an inlet 2*b*** and the coal material is pulverized therein at a high concentration to provide a slurry moiety (E) consisting of an aqueous high concentration coal slurry containing pulverized coal particles having a size of 100 μm or less.

In the pulverizer **1*b***, the dispersing additive is preferably in an amount of from 0.3% to 0.8% based on the weight of the coal particles.

The slurry moiety (E) is introduced from the pulverizer **1*b* into the kneader 10 through a conduit 3*b*** and mixed with the slurry moiety (G) therein.

In an example, an aqueous high concentration coal slurry was prepared by the process as indicated in FIG. 6 or 7.

A slurry moiety (E) was prepared from a coal material, water, and an anionic surface active agent in an amount of 0.4% based on the weight of the coal material in the pulverizer 1*b*. The resultant slurry moiety (E) contained pulverized coal particles at a coal particle concentration of 60% to 80% by weight. The pulverized coal particles had a size of 100 μm or less and contained particles having a size of 10 μm or less in a content of 40%, based on the entire weight of the coal particles. The slurry moiety (E) was fed into the kneader 10.

A cake moiety (F) was prepared from a coal material and water free from the dispersing additive by using the pulverizer 1*a*, the classifying device 4, and the dehydrating device 5, and then fed together with an aqueous medium into the kneader 6 to provide a slurry moiety (G) containing coal particles having a size of 500 μm or less and in a concentration of 60% to 80% by weight.

The mixing ratio of the slurry moiety (E) to the slurry moiety (G) corresponded to a mixing ratio in weight of the coal particles in the slurry moiety (E) to those in the slurry moiety (G), of 70:30.

The resultant high concentration coal aqueous slurry contained pulverized coal particles having a size of 300 μm or less and in a concentration of about 70%, and had a variation coefficient C of the size of the coal particles of 0.473.

In accordance with the present invention, an aqueous coal slurry having a high concentration and a high dispersion stability of coal particles during storage and transportation, and thus utilizable for industrial use, can be obtained by controlling only the largest size of the coal particles and the variation coefficient C of size of coal particle to specific levels, respectively.

Also, the present invention effectively reduces the amounts of the dispersing agent and/or stabilizer needed to stabilize the coal particles dispersion.

We claim:

1. A process for producing an aqueous high concentration coal slurry, comprising the steps of:

(1) pulverizing a coal material at a high concentration of 60 to 80% by weight in an aqueous medium containing a dispersing additive, to provide a slurry moiety (E) consisting of a high concentration aqueous coal slurry containing coal particles having a size of 100 μm or less; and (2) separately providing a cake moiety (F) consisting of dehydrated coal cakes containing coal particles having a size of 500 μm or less, by pulverizing a coal material in a low concentration of from 30% to 50% by weight in water free from the dispersing additive, and dehydrating the resultant low concentration aqueous coal slurry; and (3) mixing and kneading the cake moiety (F) with one or both of an aqueous medium and portion of the final high concentration coal aqueous slurry to provide a slurry moiety (G) consisting of an aqueous slurry of coal particles in a concentration of 60% to 80% by weight; and then (4) mixing the slurry moiety (E) with the slurry moiety (G) in a mixing ratio such that the ratio in weight of the coal particles in the slurry moiety (E) to those in the cake moiety (F) is in the range of from 8:2 to 5:5, wherein the resultant aqueous high concentration coal slurry contains coal particles having a size of 5 μm or less in an amount of 15% by weight or more based on the total weight of the coal particles, and the resultant high concentration aqueous coal slurry comprises coal particles having a particle size of 500 μm or less and dispersed in an aqueous medium in the presence of a dispersing additive, at a particle size distribution in which a coefficient of variation in size of the coal particles is from 0.3 to 0.75 determined in accordance with the equation (I):

$$C=\sigma/M \quad \text{(I)}$$

wherein C represents the coefficient of variation in the size of the coal particles, M represents an average general logarithmic size of the coal particles calculated in accordance with the equation (II):

$$M=\Sigma(\log_{10}Si)\times Vi \quad \text{(II)}$$

in which M is as defined above, Si represents an average size in μm of the coal particles in fraction No. i which is one of a plurality of fractions provided by dividing the entire amount of the coal particles in accordance with the order of the particle size, each fraction consisting of coal particles having a size in a predetermined range, and Vi represents a ratio of the amount in weight or volume of the portion of the coal particles in fraction No. i to the entire amount of the coal particles, and σ represents a standard deviation of the size of the coal particles calculated in accordance with the equation (III):

$$\sigma=(\Sigma((\log_{10}si-M)^2\times Vi))^{0.5} \quad \text{(III)}$$

in which Si, M and Vi are as defined above.

2. The process as claimed in claim 1, wherein in step (4) the cake moiety (F) is further mixed with a dispersing additive in an amount of 0.3% to 0.8% based on the weight of the coal in the slurry moiety (G).

3. The process as claimed in claim 1, wherein the coefficient of variation in size of coal particles is from 0.5 to 0.75 determined in accordance with the equation (I).

* * * * *